US006595082B2

(12) United States Patent
Liimatta et al.

(10) Patent No.: US 6,595,082 B2
(45) Date of Patent: Jul. 22, 2003

(54) ADJUSTABLE PEDAL SYSTEM WITH FAIL-SAFE DEVICE

(75) Inventors: Irving F Liimatta, Pontiac, MI (US); Eric C Trombley, Chesterfield, MI (US); Michael Todd Moury, Shelby Township, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/898,308

(22) Filed: Jul. 3, 2001

(65) Prior Publication Data

US 2003/0005790 A1 Jan. 9, 2003

(51) Int. Cl.[7] ..... G05G 1/14
(52) U.S. Cl. ..... 74/512; 74/513
(58) Field of Search ..... 74/512, 513, 514, 74/560, 561, 522, 500.5

(56) References Cited

U.S. PATENT DOCUMENTS 3,643,525 A * 2/1972 Gibas ..... 74/512
4,870,871 A 10/1989 Ivan
5,460,061 A 10/1995 Redding et al.
5,722,302 A 3/1998 Rixon et al.
6,189,409 B1 * 2/2001 Neag et al. ..... 74/512
6,352,007 B1 * 3/2002 Zhang et al. ..... 74/512
6,407,526 B1 * 6/2002 Black et al. ..... 310/75 B
6,450,061 B1 * 9/2002 Chapman et al. ..... 74/512
2002/0078782 A1 * 6/2002 Flynn ..... 74/512
2002/0096011 A1 * 7/2002 Chapman et al. ..... 74/512

* cited by examiner

*Primary Examiner*—David Fenstermacher
*Assistant Examiner*—Vicky A. Johnson
(74) *Attorney, Agent, or Firm*—Kathryn A. Marra

(57) ABSTRACT

An adjustable pedal system has a first pedal pivotally attached to the translatable nut of a first jack screw actuator for adjusting the fore and aft position of the first pedal and a second pedal pivotally attached to the translatable nut of a second jack screw actuator for adjusting the fore and aft position of the second pedal. An electric motor drives the translatable nuts fore and aft, and a fail-safe device that includes a motor control switch operated by the fore and aft movements of two of the nuts limits misalignment of the two pedals due to adjustments.

9 Claims, 3 Drawing Sheets

ADJUSTABLE PEDAL SYSTEM WITH FAIL-SAFE DEVICE

FIELD OF THE INVENTION

This invention relates to an adjustable pedal system for an automobile.

BACKGROUND OF THE INVENTION

Adjustable pedal systems are known in the art. These adjustable pedal systems allow the driver to adjust the position of the brake and accelerator pedals (and clutch pedal in automobiles with manual transmissions) fore and aft for greater comfort and for greater distance from a steering wheel mounted air bag.

These adjustable pedal systems often comprise a jack screw actuator for each adjustable pedal and in some instances the rotary screws, also known as threaded members, of several jack screw actuators are rotated by a common power source, such as an electric motor. See for instance, U.S. Pat. No. 4,870,871 granted to Steve D. Ivan Oct. 3, 1989; U.S. Pat. No. 5,460,061 granted to Harry L. Redding et al Oct. 24, 1995 and U.S. Pat. No. 5,722,302 granted to Christopher J. Rixon et al Mar. 3, 1998.

The Redding '061 patent and the Rixon '302 patent both disclose arrangements that have two flexible, torsionally rigid cables that transfer drive from a single power source, an electric motor, to two jack screw actuators, each of which adjusts a different pedal. A drawback of these adjustable pedal systems is that one pedal can be adjusted while the other pedal remains stationary if one of the power transfer cables breaks. This results in pedal misalignment which in turn may result in an awkward and uncomfortable operation for the vehicle driver.

SUMMARY OF THE INVENTION

The adjustable pedal system of this invention has a single power source, such as an electric motor that drives a plurality of jack screw actuators with flexible, but torsionally rigid, cables. Each pedal is driven by one of the jack screw actuators that is driven by one of the cables. An aligned fore—aft location of the various pedals, such as the accelerator pedal and the brake pedal (i.e. pedal step-over) must be maintained within certain desirable limits. The adjustable pedal system of the invention maintains the fore-aft alignment of the various pedals by controlling the electric motor with a fail-safe device that is mechanically connected to the adjustable pedals; the device being operated when the adjustable pedals are out of alignment by a predetermined amount to de-energize the electric motor. This feature prevents pedal misalignment during the adjustment process even if one of the drive cables breaks so that one of the pedals is not moved by its associated jack screw actuator during the adjustment process.

BRIEF DESCRIPTION OF THE DRAWINGS

The presently preferred embodiment of the invention is disclosed in the following description and in the accompanying drawings, wherein.

DETAILED DESCRIPTION OF PREFERRED EMBODIMENT

Figure 1:
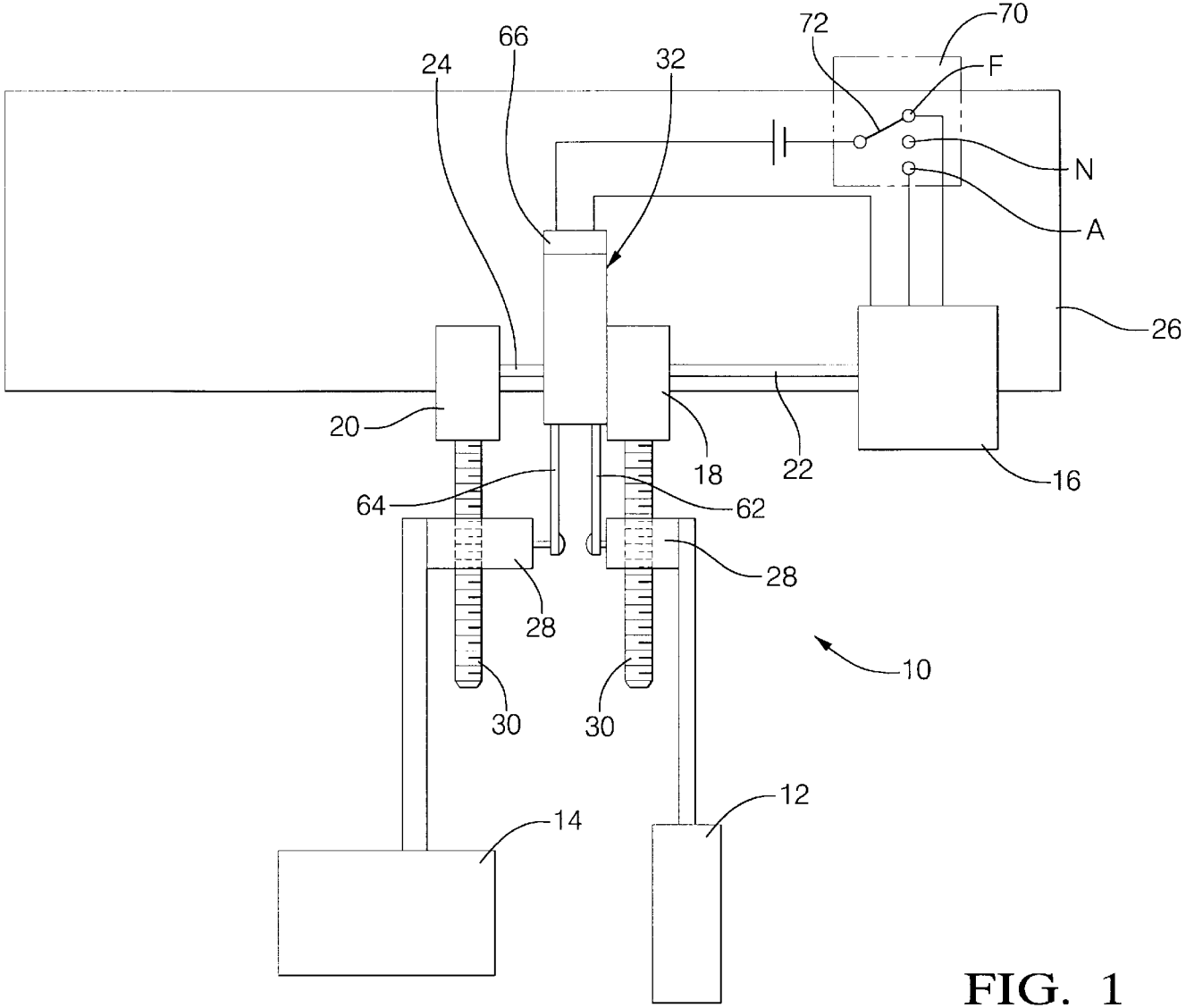
FIG. 1 is a schematic plan view of an adjustable pedal system in accordance with the invention.

Referring now to the drawing, FIG. 1 is a schematic plan view of an adjustable pedal system 10 of the invention comprising an accelerator pedal 12 and a brake pedal 14 which are commonly used in all automobiles. Pedals 12 and 14 control the engine throttle and the vehicle brakes respectively through suitable linkages that are not shown because any suitable linkage may be used. Pedals 12 and 14 in turn are controlled by foot and leg movements of the vehicle driver. The positioning of pedals 12 and 14 with respect to the driver is important to the comfort of the driver. The adjustable pedal system 10 allows the driver to position the pedals 12 and 14 fore and aft for greater comfort and for greater distance from a steering wheel mounted air bag.

Pedal adjustment in the system of the invention is achieved by a single power source, such as electric motor 16 that drives individual actuators for adjusting pedals 12 and 14, such as jack screw actuators 18 and 20, with flexible, but torsionally rigid, cables 22 and 24 as shown in FIG. 1. Motor 16 and jack screw operators 18 and 20 are mounted on a support 26 that may be part of a vehicle body or a bracket or brackets attached to the vehicle body. Each pedal is adjusted by one of the jack screw actuators which is turn is driven by at least one of the flexible cables. For instance, accelerator pedal 12 is adjusted by jack screw actuator 18 which in turn is driven by cable 22 which in turn is driven directly by motor 16. On the other hand, brake pedal 14 is adjusted by jack screw actuator 20 which is driven by cable 24 which in turn is driven indirectly by motor 16 via actuator 18 and cable 22. Motor 16 could be replaced by a motor having a drive shaft at each end and repositioned, for instance between actuators 18 and 20 thereby shortening the drive line to actuator 20. In any event, each pedal is driven by its own actuator which in turn is driven by at least one cable.

Jack screw actuators are well know in the art and need not be described in detail. Suffice it to state that each jack screw actuator has a nut 28 that is translated fore or aft with respect to the screw when the screw 30 is rotated one way or the other. Pedals 12 and 14 are pivotally mounted on the nuts 28 of the respective jack screw actuators 18 and 20 so that pedals 12 and 14 move fore or aft in unison with nuts 28 when jack screw actuators 18 and 20 are driven by the common electric motor 16.

As indicated above, the fore—aft alignment of the various pedals (pedal step-over) must be maintained within certain desirable limits. It is conceivable that the flexible cable 24 could break. If this occurred, accelerator pedal 12 could move fore or aft during the adjustment process while brake pedal 14 remains stationery.

Figure 2:
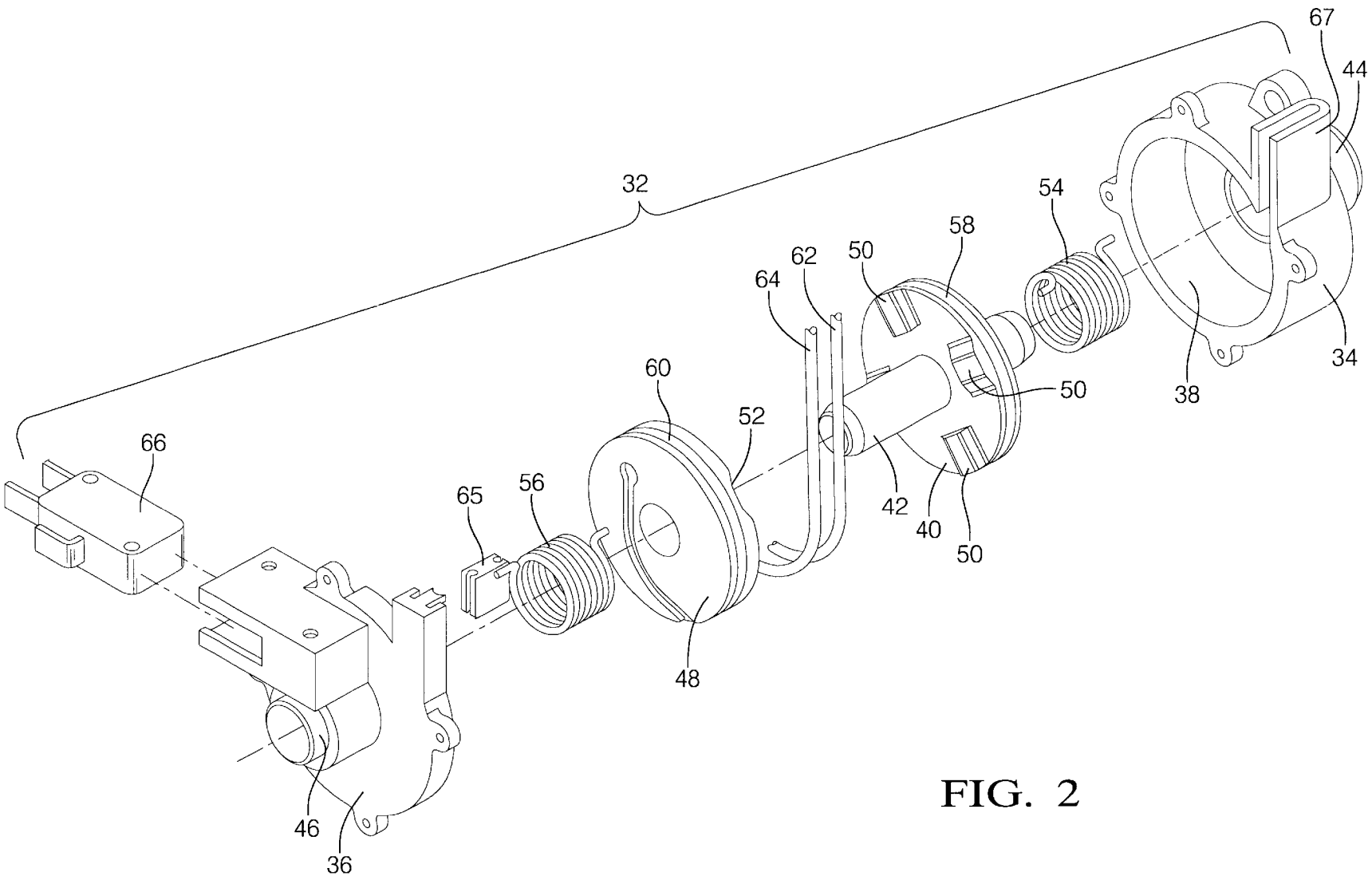
FIG. 2 is an exploded perspective of a fail-safe component of the adjustable pedal system that is shown in FIG. 1.
Figure 3:
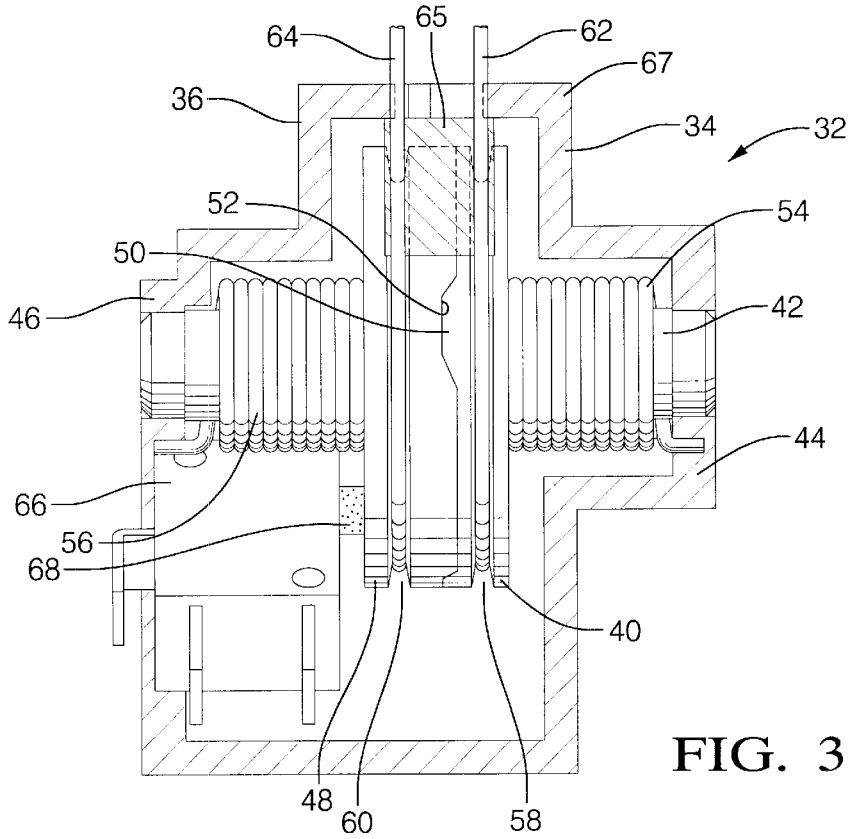
FIG. 3 is a partial front view of the fail-safe component of FIG. 2 during normal operation.
Figure 4:
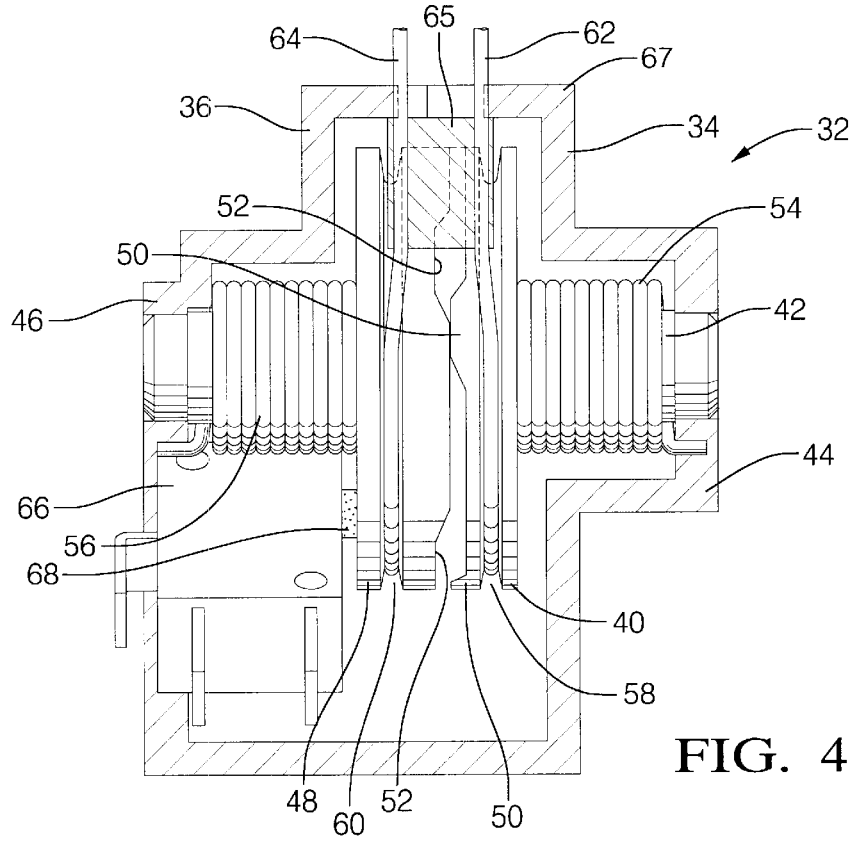
FIG. 4 is a partial front view of the fail-safe component of FIG. 2 when activated by an abnormal condition.

The adjustable pedal system of the invention maintains the fore-aft alignment of the various pedals by controlling the electric motor 16 with a switch that is part of a fail-safe device 32 that is shown in detail in FIGS. 2, 3 and 4. The switch is mechanically connected to the adjustable pedals 12 and 14 and changes modes when the adjustable pedals are out of alignment by a predetermined amount to de-energize the electric motor 16. This feature prevents pedal misalignment during the adjustment process even if drive cable 24 breaks so that pedal 14 is not moved by its associated jack screw actuator 20 during the adjustment process.

Referring now to FIGS. 2, 3 and 4 fail-safe device 32 comprises a housing 34 and a cover 36 that is attached to the housing to form a chamber 38. A first rotor 40 is disposed in chamber 38 and secured on a concentric axle 42 so that rotor 40 does not rotate or translate with respect to axle 42. Axle 42 has its outer ends journalled in bearing portions 44 and 46 of housing 34 and cover 36 respectively so that rotor 40 rotates in chamber 38.

Fail-safe device 32 includes a second rotor 48 that disposed in chamber 38 and that is mounted on axle 42 next to the first rotor 40 in a non fixed manner so that rotor 48 is free to rotate and translate with respect to rotor 40. The radial face of rotor 40 that is next to rotor 48 has a plurality of circumferentially spaced cams 50 at the periphery of the radial face that project in the axial direction as best shown in FIGS. 3 and 4. Cams 50 are received in a plurality of circumferentially spaced pockets 52 in the adjacent radial face of rotor 48 that act as cam followers. Cams 50 and pockets 52 are bi-directional, preferably V-shaped as shown in FIG. 3, so that rotors 40 and 48 are spread apart when rotor 40 is rotated or rotationally displaced with respect to rotor 48 either in the clockwise or the counter-clockwise direction.

Fail-safe device 32 further includes first and second torsion springs 54 and 56 that are substantially identical in size and spring rate or constant. Torsion springs 54 and 56 surround axle 42 outboard of rotors 40 and 48 respectively. One end of torsion spring 54 is fastened to housing 34 and the other end is fastened to rotor 40 while one end of torsion spring 56 is fastened to cover 36 and the other end is fastened to rotor 48. Torsion springs 54 and 56 thus bias rotors 40 and 48 toward an aligned position shown in FIG. 3 where rotors 40 and 48 engage each other, with substantially equal force.

Rotors 40 and 48 have grooves 58 and 60 respectively so that rotors 40 and 48 act as spools for cables 62 and 64 that are attached at one end in the bottom of the respective grooves 58 and 60 of rotors 40 and 48, respectively. Cables 62 and 64 are wound on rotors 40 and 42 and then threaded through a separator guide 65 in an exit channel 67 formed by the housing 34 and cover 36. After exiting channel 67, cables 62 and 64 are attached at their opposite ends to the translatable nuts 28 of actuators 18 and 20 respectively.

Fail-safe device 32 further includes a switch 66 that is mounted on cover 36 and that has a plunger 68 that protrudes into chamber 38. Plunger 68 is spring biased into engagement with outer radial face of rotor 48 so that switch 66 is operated by the axial position of rotor 48 on axle 42. Switch 66 has two modes. A alignment mode (usually switch closed) where motor 16 can be energized to adjust the fore and aft positions of pedals 12 and 14 and a misalignment mode (usually switch open) where motor 16 is de-energized or prevented from being energized. When pedals 12 and 14 are aligned, the radial face of rotor 48 abuts the radial face of rotor 40. Rotor 48 is spaced a maximum distance from switch 66 and plunger 68 is extended. Under such conditions, switch 66 is in the alignment mode where motor 16 can be energized.

Pedals 12 and 14 are adjusted by operating a suitable control, such as control 70 which may be a three way selector switch operated by a control handle 72 that has forward, neutral and aft positions "F", "N" and "A". When control handle 72 is placed in the forward position "F", motor 16 is energized to rotate in one direction, for instance clockwise, which drives actuators 18 and 20 in unison so that nuts 28 and the pedals 12 and 14 attached to nuts 28 move forward in unison, that is toward support 26. As nuts 28 move forward, cables 54 and 56 unwind against the reaction of torsion springs 54 and 56 and rotate rotors 40 and 48 in unison so that rotor 48 remains abutted against rotor 40 keeping switch 66 in the aligned position where electric motor 16 is allowed to continue operating. When pedals 12 and 14 reach the desired forwardly adjusted position, control handle 72 is moved to the neutral position "N" which de-energizes motor 16. Pedals 12 and 14 are thus located in the desired forward adjusted position with energy stored in torsion springs 54 and 56 which have been wound up during the forward adjustment process.

Pedals 12 and 14 are moved to a desired aft position by moving control handle 72 to the aft position "A" which energizes motor 16 to rotate in the opposite or counter-clockwise direction so that nuts 28 and pedals 12 and 14 move aft in unison. As nuts 28 move aft, cables 54 and 56 are wound onto the respective rotors 40 and 48 by the energy stored in springs 54 and 56 which unwind to rotate rotors 40 and 48 in unison. Rotor 48 remains against rotor 40 keeping switch 66 in the aligned position where motor is allowed to continue operating. When pedals 12 and 14 reach the desired aft adjustment, control handle 72 is moved to the neutral position "N" which de-energizes motor 16. Pedals 12 and 14 are thus located in the desired aft adjusted position.

If cable 24 is broken so that actuator 20 is not driven when motor 16 is engergized, pedal 12 will pull ahead of pedal 14 and rotate rotor 40 with respect to rotor 48 in proportion to the amount of misalignment between pedal 12 and pedal 14. This relative rotation or angular displacement of rotor 40 with respect to rotor 48, spreads rotors 40 and 48 apart and depresses plunger 68 in proportion to the misalignment. When the misalignment between pedal 12 and pedal 14 reaches a predetermined amount, plunger 68 changes switch 66 to the misaligned mode denergizing motor 16 and preventing any subsequent energization of motor 16 until pedals 12 and 14 are aligned or within the range of allowed misalignment.

In the adjustable pedal system 10 described above, the pedals 12 and 14 are pivotally attached to the nuts 28 of the respective jack screws 18 and 20 by lever arms forming part of the respective pedal. However, the pedals can be immovable fixed to the nuts 28 or any part that is moved by the nuts 28 depending on the mechanism that adjusts the positions of the pedals. See for instance, the Rixon '302 patent discussed above. In other words, although the preferred embodiment of the present invention have been disclosed, various changes and modifications may be made thereto by one skilled in the art without departing from the scope and spirit of the invention as set forth in the appended claims. It is also understood that the terms used herein are merely descriptive, rather than limiting, and that various changes may be made without departing from the scope and spirit of the invention.

We claim:

1. An adjustable pedal system comprising, a first pedal attached to a first actuator for adjusting position of the first pedal in a fore and aft direction, a second pedal attached to a second actuator for adjusting position of the second pedal in the fore and aft direction, a power source drivingly connected to the first actuator and to the second actuator to move the first pedal and the second pedal, respectively in the fore and aft direction, and a fail-safe device connected to a first moving part of the first actuator and to a second moving part of the second actuator to limit misalignment of the first pedal with respect to the second pedal in the fore and aft direction;

the fail-safe device having a first rotor that is connected to the first moving part, a second rotor that is connected to the second moving part, the first rotor having a cam and second rotor having a cam follower, the cam follower engaging the cam to spread the first rotor and the second rotor apart in an axial direction responsive to relative rotation of the first rotor with respect to the second rotor.

2. The adjustable pedal system as defined in claim 1 wherein the first rotor and the second rotor have an aligned position where the first rotor and the second rotor are closest to each other in the axial direction and wherein the fail-safe device includes a first torsion spring biasing the first rotor toward the aligned position, and a second torsion spring biasing the second rotor toward the aligned position.

3. The adjustable pedal system as defined in claim 2 wherein the cam and the cam follower are bi-directional.

4. An adjustable pedal system comprising, a first pedal attached to a first actuator for adjusting position of the first pedal in a fore and aft direction, a second pedal attached to a second actuator for adjusting position of the second pedal in the fore and aft direction, a power source drivingly connected to the first actuator via a first drive cable and to the second actuator via a second drive cable to move the first pedal and the second pedal, respectively in the fore and aft direction, and a fail-safe device to limit misalignment of the first pedal with respect to the second pedal in the fore and aft direction having a first rotor connected to a first moving part of the first actuator and a second rotor connected to a second moving part of the second actuator, the first rotor and the second rotor having an aligned position where the first rotor and the second rotor are closest to each other in an axial direction, the fail-safe device including a first torsion spring biasing the first rotor toward the aligned position, and a second torsion spring biasing the second rotor toward the aligned position, and the first rotor having a plurality of circumferentially spaced cams and second rotor having a plurality of circumferentially spaced cam followers, the cam followers engaging the cams to spread the first rotor and the second rotor apart in the axial direction responsive to relative rotation of the first rotor with respect to the second rotor.

5. The adjustable pedal system as defined in claim 4 wherein the first rotor is juxtaposed the second rotor, the first torsion spring is outboard of the first rotor, and the second torsion spring is outboard of the second rotor.

6. The adjustable pedal system as defined in claim 5 wherein the cams and the cam followers are bi-directional.

7. An adjustable pedal system comprising, a first pedal attached to a first actuator via a first drive cable for adjusting position of the first pedal in a fore and aft direction, a second pedal attached to a second actuator via a second drive cable for adjusting position of the second pedal in the fore and aft direction, an electric motor drivingly connected to the first actuator and to the second actuator to move the first pedal and the second pedal, respectively in the fore and aft direction, and a fail-safe device to limit misalignment of the first pedal with respect to the second pedal in the fore and aft direction having a first rotor connected to a first moving part of the first actuator by a first cable and a second rotor connected to a second moving part of the second actuator by a second cable, the first rotor and the second rotor having an aligned position where the first rotor and the second rotor are closest to each other in an axial direction, the fail-safe device including a first torsion spring biasing the first rotor toward the aligned position, and a second torsion spring biasing the second rotor toward the aligned position, and the first rotor having a plurality of circumferentially spaced cams and second rotor having a plurality of circumferentially spaced cam followers, the cam followers engaging the cams to spread the first rotor and the second rotor apart in the axial direction responsive to relative rotation of the first rotor with respect to the second rotor, and the fail-safe device including a switch that controls operation of the electric motor and that is responsive to the position of one of the first rotor and the second rotor in the axial direction.

8. The adjustable pedal system as defined in claim 7 wherein the first rotor is juxtaposed the second rotor, the first torsion spring is outboard of the first rotor, the second torsion spring is outboard of the second rotor, the switch is outboard of the one of the first rotor and the second rotor, and the switch has a plunger that engages the one of the first rotor and the second rotor.

9. The adjustable pedal system as defined in claim 8 wherein the cams and the cam followers are bi-directional.

* * * * *